US008518195B2

(12) United States Patent
Bradley

(10) Patent No.: US 8,518,195 B2
(45) Date of Patent: Aug. 27, 2013

(54) HEAT TREATMENT FOR PRODUCING STEEL SHEET WITH HIGH STRENGTH AND DUCTILITY

(75) Inventor: John R. Bradley, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 61 days.

(21) Appl. No.: 13/354,589

(22) Filed: Jan. 20, 2012

(65) Prior Publication Data

US 2013/0186527 A1 Jul. 25, 2013

(51) Int. Cl.

| | |
|---|---|
| ***C21D 8/00*** | (2006.01) |
| ***C21D 9/46*** | (2006.01) |
| ***C21D 9/00*** | (2006.01) |

(52) U.S. Cl.

USPC ..... 148/664; 148/649; 148/650; 148/654; 148/662

(58) Field of Classification Search

USPC ..... 148/660–664, 649, 650, 654

See application file for complete search history.

(56) References Cited

U.S. PATENT DOCUMENTS

| | | | | |
|---|---|---|---|---|
| 3,278,345 | A * | 10/1966 | Grange et al. | 148/654 |
| 3,288,657 | A * | 11/1966 | Morita et al. | 148/661 |
| 3,370,994 | A * | 2/1968 | Konkol | 148/621 |
| 4,067,756 | A * | 1/1978 | Koo et al. | 148/662 |
| 6,355,119 | B1 * | 3/2002 | Peters et al. | 148/664 |
| 2003/0221754 | A1 * | 12/2003 | Kusinski et al. | 148/664 |

FOREIGN PATENT DOCUMENTS

| | | |
|---|---|---|
| WO | 2004022794 | 3/2004 |

* cited by examiner

*Primary Examiner* — Deborah Yee

(74) *Attorney, Agent, or Firm* — Reising Ethington P.C.

(57) ABSTRACT

The microstructure of a low alloy steel workpiece for cold forming may be beneficially modified by heating the workpiece to a temperature just above its austenite transformation temperature ($Ac_3$ temperature). The steel workpiece is then cooled just below its $Ac_3$ temperature to promote ferrite formation on and between the austenite grains. Heating and cooling, above and below the $Ac_3$ temperature, is repeated a determined number of times to refine the austenite grains before the workpiece is quenched below its martensite transformation temperature to form a mixture of martensite with increased retained austenite. The workpiece may be further heated in its martensite region to increase the proportion of retained austenite before quenching the steel workpiece to an ambient temperature. The formability of the workpiece is improved, as is the strength of its formed shape.

10 Claims, 2 Drawing Sheets

HEAT TREATMENT FOR PRODUCING STEEL SHEET WITH HIGH STRENGTH AND DUCTILITY

TECHNICAL FIELD

This disclosure pertains to the heat treatment of low alloy carbon steel workpieces, often in the form of rolled sheets or strips, to increase the formability of the workpieces during, for example, stamping, while obtaining stronger formed parts. More specifically, this disclosure pertains to a heat treatment in which a low alloy steel sheet or workpiece(s) is cycled above and below its austenite transformation temperature ($A_3$ temperature) in a predetermined schedule before the workpiece is quenched below its Ms temperature to form a desired mixture of martensite and retained austenite in its refined microstructure. The effect of such thermal cycling is to increase the formability of the starting workpiece while yielding a higher strength formed product.

BACKGROUND OF THE INVENTION

Sheets and strips of plain carbon steel compositions have been used in forming body structural members and body panels for automotive vehicles for many years. Such steel workpieces can be stamped or otherwise formed into the various, often complicated body member shapes and display strengths required of such manufactures. But with the increasing need to reduce vehicle weight for improved fuel economy it has been necessary to reduce thicknesses of the steel sheets and strips and to increase the formability of such workpieces, while seeking to obtain even higher strengths in the formed vehicle body components and other structures.

In accordance with an American Iron and Steel Institute description, "Steel is considered to be carbon steel when no minimum content is specified for chromium, cobalt, molybdenum, nickel, niobium, titanium, tungsten, vanadium, or zirconium, or any other element to be added to obtain a desired alloying effect; when the specified minimum for copper does not exceed 0.40 percent; or when the maximum content for any of the following elements does not exceed the percentages noted: manganese 1.65, silicon 0.60, copper 0.60." The carbon content is not specified in this definition. Low alloy steels typically contain small amounts of one or more of manganese, nickel, chromium, molybdenum, vanadium, and silicon. For example, a representative, low carbon, low alloy steel may be composed of, by weight, 0.25% max carbon, 0.4% to 0.7% manganese, 0.1% to 0.5% silicon, and the balance iron except for trace amounts of other elements introduced though re-cycling and other processing of starting material.

In preparation for making automotive vehicle body components, such plain and low carbon steel compositions are shaped from cast ingots into rolls of sheets or strips by a combination of hot rolling and cold rolling operations. Depending on their thermal and mechanical processing history, such hot and cold rolled steels may have a variety of microconstituents at ambient temperatures. Such microconstituents may comprise ferrite ($\alpha$-iron)—a body-centered cubic crystal structure of iron atoms; iron carbide or "cementite;" retained austenite ($\gamma$-iron)—a face-centered cubic crystal structure of iron atoms with dissolved carbon; and martensite—a metastable body-centered phase of iron supersaturated with carbon, produced through a diffusionless phase change by quenching austenite. A typical microstructure produced by cooling the high temperature austenite phase at moderate cooling rates would consist of proeutectoid ferrite (ferrite which separates from hypoeutectoid austenite above the eutectoid temperature) and pearlite or bainite, or more generally, a combination of these constituents. Pearlite is formed by cooperative growth of alternating ferrite and cementite lamellae from austenite of eutectoid composition (iron with 0.8% by weight carbon) at relatively small undercooling. Bainite is formed from austenite at higher undercooling and consists of ferrite plates in combination with fine carbides precipitated either between or inside the plates. At sufficiently high cooling rates the transformation of the austenite to ferrite, pearlite and bainite can be precluded by its transformation to the metastable martensite phase by a diffusionless shear transformation. Depending on the steel composition, cooling rate and quench temperature, a portion of the austenite phase can be retained in the microstructure at ambient temperatures. Among the parameters that encourage the stability of retained austenite are high carbon content and a fine grain size.

In order to obtain a microstructure suitable for a subsequent sheet forming operation, the cold rolled, ferritic steel workpieces are typically heated above their respective $A_3$ temperatures (e.g., close to 900° C., depending on the composition of the steel alloy) to obtain a uniformly austenitic crystal structure and then quenched below their Ms Temperature (e.g., about 400° C., again depending on the steel composition) to convert a portion of the austenite phase to martensite. The resulting proportions of newly formed martensite and retained austenite affect the formability and strength of the steel workpiece. Such a heat treatment practice may be performed by the steel supplier or by the manufacturer that is going to deform the steel sheet or strip material into a stamped or otherwise shaped product. The manufacturer of the vehicle body components obtains the sheet or strip material, and cuts suitable sections from it for the forming of the parts. The parts may be shaped at an ambient temperature in a stamping plant or formed in a heated press or other metal-forming machine.

The strip or sheet workpieces have become progressively thinner as higher strength steel microstructures have been produced. A goal of a steel processer into vehicle body components is to start with a low alloy steel workpiece that is highly formable at a desired forming temperature (typically an ambient temperature) and then to produce a formed steel part that is very strong and of light weight. But these two goals of initial low strength and high formability and final complex shape and high strength have been difficult to attain. Sheet steels designed specifically to meet the more recent demands for better combinations of high strength and ductility have been categorized as Advanced High Strength Steels.

One approach to achieving Advanced High Strength Steels with the necessary combination of both increased strength and increased ductility relies on the ability to retain the high temperature austenite phase in the steel microstructure prior to forming. Upon quenching the austenitic steel there is a tendency for some of the high temperature austenite phase to be retained as such in the quenched microstructure rather than transform to the martensite phase or other austenite decomposition products. Steels specifically alloyed and processed to contain a significant amount of retained austenite can undergo Transformation Induced Plasticity whereby strain induced transformation of the retained austenite during forming results in greater levels of both strength and ductility. Steels can be specially formulated and processed in order to maximize the amount of retained austenite in the starting steel sheet, and thus take best advantage of the Transformation Induced Plasticity, or "TRIP" effect, which improves the ductility of the steel. As the TRIP steel is formed at room temperature, the retained austenite in the severely strained regions of the part will transform to martensite. The result is that the rate of work hardening is increased in those regions of the part which inhibits local thinning or "necking" and thus increases the ductility or formability of the steel. Steels can be formulated and processed in order to retain greater amounts of austenite prior to deformation thus achieving greater combinations of strength and ductility in the formed parts. Formulation of such a steel composition may include on the order of up to 0.4% C and 1.5% Mn. In addition to increasing both strength and hardenability of the steel, both C and Mn are strong austenite-stabilizing alloying elements which reduce the martensite start temperature and encourage the retention of austenite upon quenching. A steel alloy designed for the purpose of retaining a large fraction of austenite may also contain on the order of 1% Si or Al to suppress the formation of carbides which would otherwise deplete the carbon content of the retained austenite making it less stable at room temperature.

The prior practices for retaining austenite in the low alloy steel sheet material prior to the forming of the steel workpieces have used a standard austenitization heat treatment, or, alternatively, preheating the steel in the two-phase intercritical temperature range as the initial processing step prior to quenching. There remains a need for improved methods of retaining and/or modifying austenite in low alloy content steel sheets and strips so that they can more readily be formed into complex three-dimensional shapes that display high strength and rigidity for vehicle applications and other uses.

SUMMARY OF THE INVENTION

In accordance with practices of this invention low alloy steel workpieces are progressively heated to a first predetermined temperature, above the temperature for complete transformation of the microstructure to austenite ($A_3$), for the specific composition of the alloy. Again, the $A_3$ temperature of the low alloy steel may be upwards of about 900° C., depending on the alloy content of the steel. The carbon content of the austenite grains is the same as the carbon content of the steel. The steel workpieces may, for example, be in the form of coils of sheet or strip intended for the manufacture of vehicle body components. Or the workpieces may in the form of smaller sheets or strips cut, shaped, and prepared for a forming operation. The workpiece is heated to a suitable predetermined temperature of, for example, about 10° C. above its $A_3$ temperature. The austenitized low alloy steel workpiece is then cooled to a predetermined second temperature, below its first temperature and often suitably about 10° C. below the $A_3$ temperature. This cooling step to below the $A_3$ temperature of the steel workpiece causes the formation of some proeutectoid ferrite from the just-formed austenite. A major portion of the austenite crystal structure in the workpiece is retained. Relatively small grains of ferrite form at austenite grain boundaries. After a period of seconds at the second and lower temperature, the workpiece is re-heated above the $A_3$ temperature of the workpiece. When the steel is reheated above the $A_3$ temperature, the newly precipitated proeutectoid ferrite grains are dissolved and new austenite grains are precipitated at the austenite grain boundaries and at the austenite/ferrite interface boundaries. The result is a refined austenite grain size owing to the greater number of austenite nucleation sites available upon reheating.

The holding times at the respective temperatures above and below the $A_3$ temperature may be for predetermined periods of seconds, for example, thirty seconds or less. The rate of heating may be based on practical heating practices. This thermo cycling practice may be performed, for example, by moving the workpiece between different-temperature sections of a heat-treatment furnace, sized and controlled for such cyclic thermal processing. Or the workpieces may be moved between different induction heating coils.

The purpose and function of such cyclical heat treatment between temperatures just above and below the $A_3$ temperature of the workpiece is to repeatedly precipitate relatively small amounts of proeutectoid ferrite at the lower temperature and to re-dissolve the ferrite at the higher temperature, above the $A_3$ temperature. This processing beneficially refines the grain-size of the austenite above the $A_3$ temperature and similarly refines the grain size of the austenite plus ferrite microstructure below the $A_3$ temperature. These phase transformations are enabled and controlled by carbon diffusion—which is quite fast. It is expected that the slower diffusing alloying elements such as manganese will remain at their initial concentrations in both the ferrite and austenite. This thermal cycling is repeated a few times (for example, 2 to 4 times) until a predetermined altered austenitic grain microstructure is obtained preparatory to quenching the workpiece in a suitable quenchant fluid to a predetermined temperature below the temperature of the steel composition at which martensite formation begins (starts), the Ms (martensite start) temperature.

After the austenitic microstructure has been substantially refined by thermal cycling above and below the $A_3$ temperature, the steel workpiece will be quenched to a temperature between its Ms temperature and its Mf (martensite finish) temperature. This quench temperature is chosen to form desired proportions of martensite and retained austenite. These proportions affect the ductility (and thus the formability) of the steel. In some embodiments of the invention one might rely on the improved microstructure of the retained austenite and immediately quench the steel to room temperature for subsequent forming or use. But, in many embodiments of this invention, the steel (with its refined austenite) may now be further processed by heating at or above its quench temperature for carbon enrichment of the retained austenite.

There are two possible starting conditions before quenching to a temperature between Ms and Mf. 1) If the last thermal cycle prior to quenching puts the temperature of the workpiece above the $A_3$, then the microstructure being quenched is a fine grain austenite with more or less uniform carbon concentration given by the bulk carbon content of the steel. Whatever austenite that is retained will have about the same carbon content as the steel did initially, but the grains of austenite have been beneficially altered. 2) On the other hand, the steel could just as well be quenched from a starting temperature just below the $A_3$, i.e., in the intercritical ferrite plus austenite region of phase stability. In this case the starting condition before quenching would be a fine grained ferrite plus austenite microstructure—but in this case virtually all of the carbon would be in the austenite and none in the ferrite. That is, the ferrite formed in the intercritical region prior to quenching is precipitated by rejecting carbon into the austenite. This carbon-enriched austenite that results from the ferrite precipitation would be more stable since there is more carbon in solution, but there would be less of it since there is now ferrite in the microstructure. In general it may be preferred to predetermine a tradeoff (with respect to a particular steel), between the carbon content and volume fraction of austenite prior to quench (to below Ms), that results in the greatest amount of austenite retained.

The further heating or maintenance of the carbon steel workpiece at a temperature of martensite transformation (i.e., between the Ms and Mf temperatures) permits further distribution of carbon and, possibly, other austenite stabilizing solutes to the austenite phase to further stabilize it against transformation during the final quench to room temperature. The purpose of this heat treatment process is to create a microstructure in the workpiece that both further increases its formability at room temperature while retaining the potential for further strengthening of the steel as it is formed into an article of manufacture.

Due to the previous thermal cycling of the workpiece, above and below its $A_3$ temperature before quenching, more austenite is now retained in the quenched steel, which increases it ductility and formability. The refined grain austenite formed during the thermal cycling better survives the quench below Ms (and to an ambient temperature) and the resulting microstructure with predetermined portions of martensite and retained austenite permits the forming of more complicated shapes in the steel workpiece.

The quenched workpiece may experience a time period before it is used in a sheet stamping or other shaping or manufacturing operation. But the energy of the shaping step then still further promotes the transformation of the retained austenite to martensite. This further microstructural transformation increases the ductility of the formed steel product. The smaller austenite grain size resulting from the thermal cycling (above and below the $A_3$ temperature), prior to the quench below Ms, increases the amount of retained austenite in the quenched steel and thus contributes to the enhanced formability of the steel. The smaller grain size resulting from thermal cycling also increases the strength of the steel prior to forming. And the forming operation produced on the thermally cycled and quenched steel increases the strength of the stamped sheet metal product as a result of work hardening. Thus, the advantage of the method of this invention is that more formable steel workpieces are obtained and that resulting shaped workpieces are stronger. For example, target properties sought to be obtained by this process are (i) a thirty percent total tensile elongation and a tensile strength of about 1000 MPa or (ii) a twenty percent total tensile elongation and a tensile strength of 1500 MPa. This combination of benefits is particularly useful, for example, in making lighter weight and more complexly shaped body parts for automotive vehicles.

Other objects and advantages of the invention will be apparent from illustrative embodiments presented below in this specification. In these illustrations reference will be made to drawing figures which are described in the following section of this specification.

DESCRIPTION OF PREFERRED EMBODIMENTS

The purpose of the subject heat treatment process is to produce an advanced high strength steel with improved combinations of ductility for shaping of a sheet or strip workpiece and for increased tensile strength in the shaped workpiece. This purpose is attained by subjecting a low alloy steel of standard or modified chemical composition to a new thermal cycling process prior to quenching of the workpiece and further heating of its quenched microstructure.

In general, the subject process is applicable to low alloy steels. Examples of suitable steels are commercial steels designated as TRIP (e.g., Arcelor Mittal TRIP 780) that are of suitable composition for practice of this invention. The nominal composition of AM TRIP 780 is, by weight, 0.25% carbon, 2% manganese, 2% max. of aluminum plus silicon, and the balance iron, with a microstructure of austenite and carbide-free bainite dispersed in a soft ferrite matrix.

Figure 1:
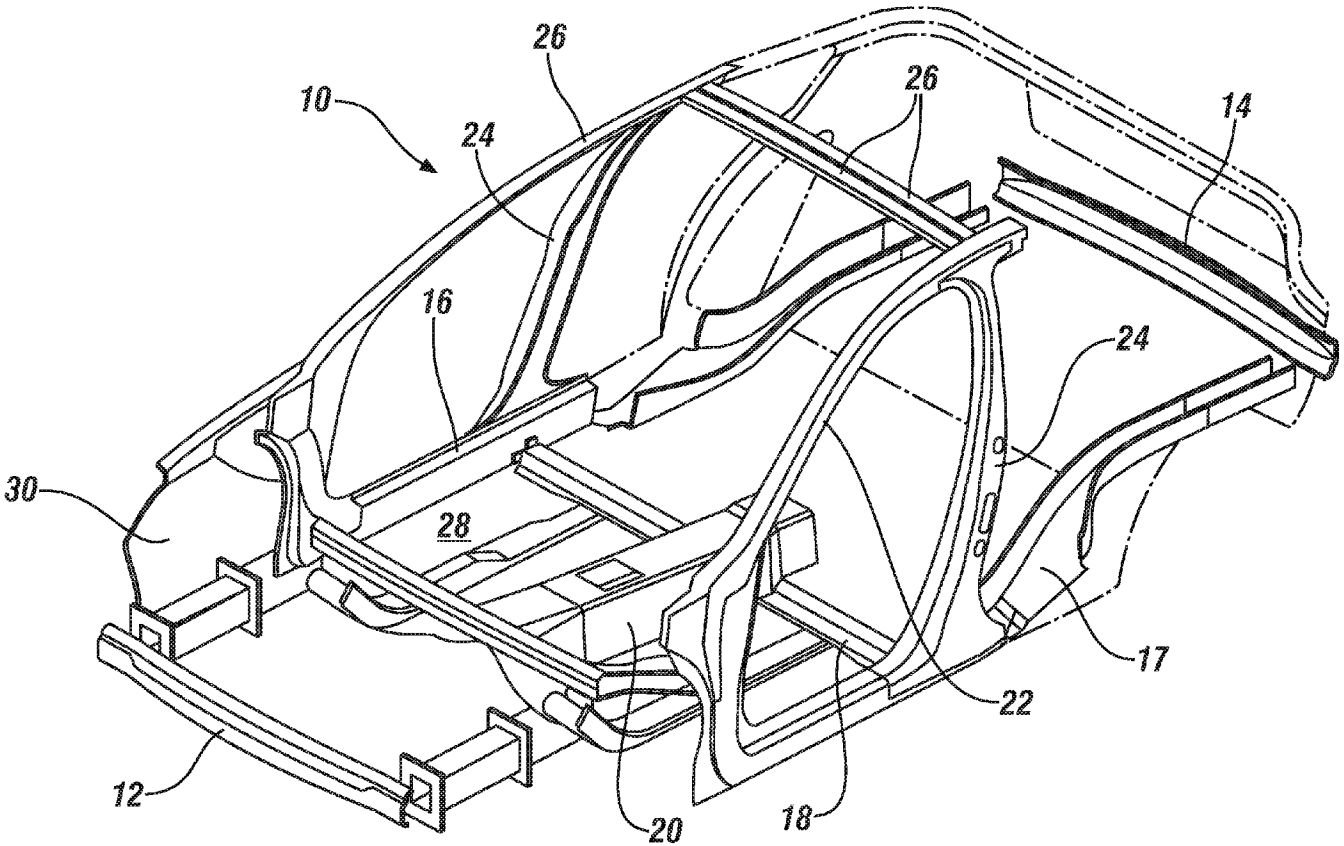
FIG. 1 is an oblique view of a representative vehicle body structure without closure panels, sometimes called a body-in-white, with skeletal structural members as examples of candidate structural body components that may be formed of steel starting workpieces, heat treated in accordance with practices disclosed herein.

There is ongoing interest is adapting low cost steels to the making of complex high strength structural body members. The body members often have a relatively long dimension in which they may be curved, and they often have a cross-section formed into a complex shape. The starting workpieces need to have suitable ductility to accommodate such forming and then the formed structural parts need to display high strength and rigidity. Examples of such structural members are illustrated in FIG. 1 of this specification.

The framework of the bodies of current automotive passenger vehicles comprises individually-formed, high strength steel unit structures of complex shape that are joined by welding into a strong unit structure. Many demands are met in the design of the body structure which must provide interior space for a power plant, for transmission of power to the wheels of the vehicle, for many accessories, and for a number of passengers. And the body structure provides protection for the passengers during vehicle operation. It is desired to form many of these structures of formable and strong steel workpieces prepared by methods of this invention. FIG. 1 illustrates a skeletal body-in-white structure 10 without side panels or roof. Examples of body members of complex cross-section shape include a front bumper 12, a rear bumper 14, side frame member 16, rear frame member 17, floor support members 18, a tunnel housing to accommodate a drive shaft 20, front support structures 22, B-pillars 24, and roof supports 26. Also, the body includes floor pans 28 and wheel enclosures 30. Each of these structural members may be formed from a suitably ductile steel sheet or strip workpiece into a curved shape along its length and with a complexly bent cross-section that provides reinforcement to the body member and means for welding to an adjacent member in the building of the overall body structure.

Examples of suitable steel compositions for use in the shaping of such vehicle structural body members include those identified above in this specification. Such compositions may be prepared in the form of rolls of long strips or sheets having a specified width and thickness for use by a manufacturer of steel parts. The heat treatment of this invention could be applied during the initial manufacture of the steel sheet coil. Sections or portions of the rolled material may be cut from the roll for shaping on suitable stamping presses or other metal forming machinery. Alternatively, the subject heat treatment process may be applied in a post treatment of sheet material from previously produced coils or blanks.

As stated above, this specification is directed to a heat treatment of steel sheet and strip material to provide good ductility for shaping and good strength in the shaped product. Practices of the invention may utilize a furnace or furnaces, or other heating methods such as, for example, induction heating, and cooling means for treatment of steel workpieces at different temperatures as specified above and in the following paragraphs of this specification.

Figure 2:
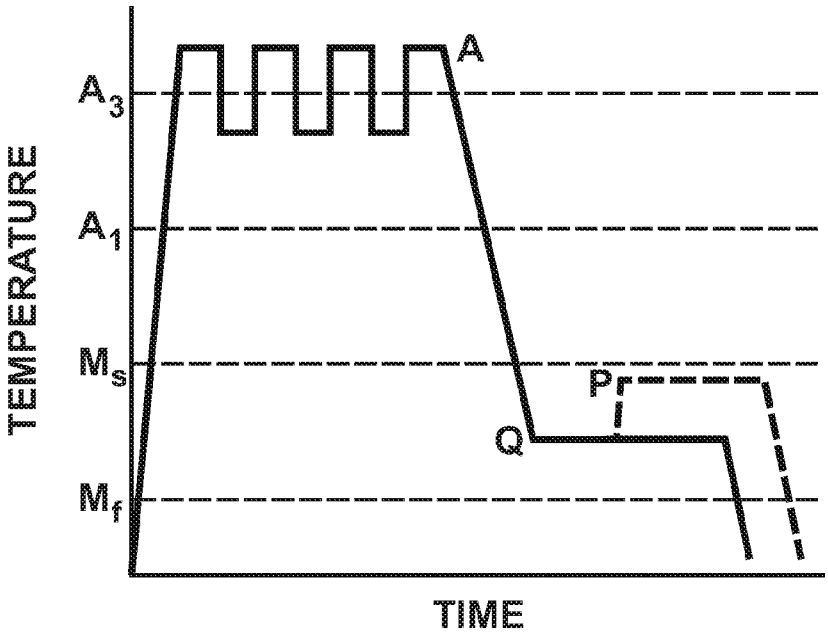
FIG. 2 is a graph of Temperature vs. Time illustrating a sequence of heating and cooling steps in an example of heat treatments for a low alloy steel workpiece in accordance with this invention. A critical feature of the heat treatment comprises heating the steel above its $A_1$ temperature and, further, above its $A_3$ temperature and then thermally cycling the steel a predetermined number of times below and above the $A_3$ temperature before the steel is quenched from its austenite region to a quench temperature, Q, below its Ms temperature for further heat treatment. Following the quench, two alternative processes are illustrated in FIG. 2. The workpiece may be maintained at its Q temperature for a time period before quenching to room temperature (typically about 25 to 30° C.), or it may be heated to a higher temperature, P, before quenching to about room temperature.
Figure 3:
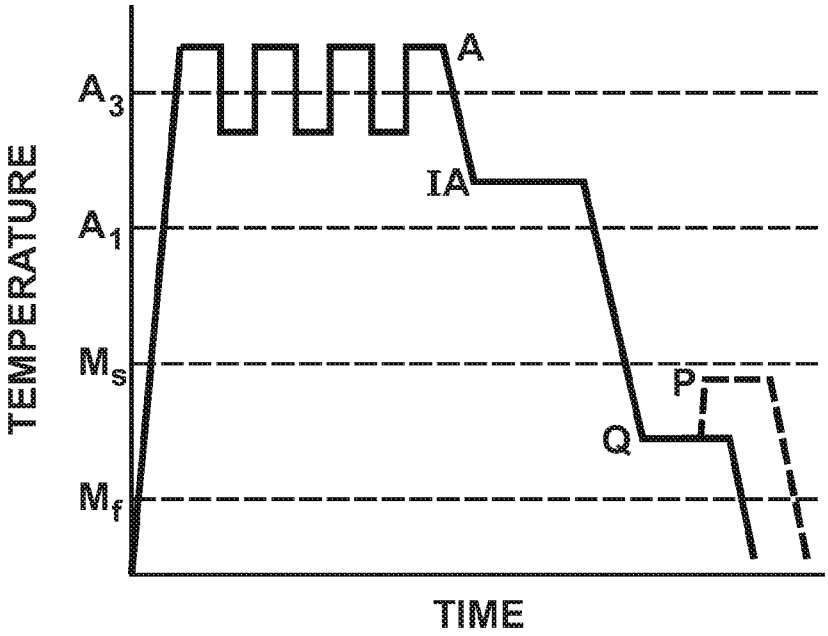
FIG. 3 is a graph of Temperature vs. Time illustrating a slightly different sequence of heating and cooling steps in an example of heat treatments for a low alloy steel workpiece in accordance with this invention. A critical feature of the heat treatment comprises heating the steel above its $A_3$ temperature and then thermally cycling the steel a predetermined number of times above and below the $A_3$ temperature before the steel is quenched from a temperature just below its $A_3$ temperature (i.e., a temperature in its intercritical temperature region) to a quench temperature, Q, below its Ms temperature for further heat treatment. As in FIG. 2, following the quench two alternative processes are illustrated in FIG. 3. The workpiece may be maintained at its Q temperature for a time period before quenching to room temperature (typically about 25 to 30° C.), or it may be heated to a higher temperature, P, before quenching to about room temperature.

Reference is made to FIGS. 2 and 3 which are graphs of heat treatment processing temperatures versus time that will be used for a general description of two practices of a new heat treatment for low alloy steel workpieces to increase their formability in an article of an initial generally flat shape and to increase the strength of a shaped article produced from the initial shape. The vertical temperature axis of the graph of FIGS. 2 and 3 indicate an unspecified $A_3$ temperature (complete austenite formation on heating at a specified rate of temperature increase), $A_1$ temperature (initial austenite formation on heating at a specified rate of temperature increase), Ms temperature (start of martensite formation on cooling, often quenching), and Mf temperature (finish of martensite formation on cooling). These values of temperatures for each steel composition are known, can be calculated, or are readily determined experimentally. Specific values of time are not shown on the horizontal axes of FIGS. 2 and 3. But in the processing, the periods of the respective steps will be of the order of several seconds to a few minutes in duration. And, in general, specific temperatures and processing times suitable for a specific low alloy steel composition and shape will be predetermined by experience or experiment in specific applications. But appreciation of processing temperatures and times will be understood from the following description. The values of the respective temperatures are reflected as horizontal lines across the graph for clarity in the description of the processing, and the processing with time is indicated by the processing lines in FIGS. 2 and 3.

Referring now to FIG. 2, a selected steel of known composition, and in the form of a workpiece for shaping, is progressively heated (at a suitably rapid rate) in a suitable furnace and atmosphere to a temperature above its $A_3$ temperature, for example above about 890° C. to transform the microstructure of the workpiece uniformly to austenite. In the fully austenitized state the carbon content of the austenite ($C\gamma$) is equal to the initial carbon concentration of the steel, Ci. As indicated by the first horizontal segment of the process line, the workpiece is held at this initial temperature above the $A_3$ temperature long enough to assure the desired fully austenite microstructure.

In prior art practices, the austenitized workpiece would now be removed from its heat treatment furnace and quenched to a temperature below its Ms temperature. Such an immediate quench process typically involves a "Quench and Partition" practice for obtaining desired portions of retained austenite and martensite in a workpiece. But this immediate quench practice in not followed in practices of this invention. In contrast, the workpiece is cyclically cooled and heated around its $A_3$ temperature to better and uniquely alter the austenite grain structure. The respective cooling, holding, and reheating periods are indicated schematically by the vertical and horizontal lines of FIG. 2. The vertical lines indicate cooling and heating periods that typically require a matter of several seconds, as described in the following text. This thermal cycling is done before the workpiece is quenched below its Ms temperature. This thermal cycling is illustrated in brief schematic summary in the heat treatment process graph presented as FIG. 2.

As indicated by the step-wise, up and down, rectangular shaped temperature-time variation in FIG. 2, the workpiece is now cooled to a temperature just below its $A_3$ temperature. This lower temperature is in the two-phase austenite-ferrite region of the temperature/phase diagram of the steel composition. The specific temperatures, both below and above the $A_3$ temperature may be determined by experience or experiment for each steel workpiece. But temperatures of about 10° C. above and below the $A_3$, with holding times of about ten seconds, are generally suitable and considered good starting points for a new steel workpiece to be processed in accordance with this invention. The workpiece is cooled to a temperature level at which the austenite (fcc) grains start to transform to proeutectoid ferrite (bcc). The ferrite material nucleates predominantly at the interfaces of austenite grains. The ferrite is formed (precipitated) with nearly zero carbon content and the carbon diffuses into the remaining austenite as the amount of ferrite phase increases and grows. After a short predetermined period (e.g., about ten seconds), the workpiece is heated to its first temperature (or the like) back in the austenite region above the $A_3$ temperature of the workpiece. This is illustrated schematically in FIG. 2.

The ferrite in the microstructure of the reheated workpiece starts to transform back into austenite, but new and smaller grains of austenite are formed. After a predetermined short time (again, e.g., about thirty seconds) at the higher temperature the workpiece is again cooled to a temperature just below its $A_3$ temperature to again commence transformation of a small portion of the austenite to ferrite. This thermal cycling just above and below the $A_3$ temperature of the workpiece is repeated a predetermined number of times before the workpiece is ultimately quenched to a temperature below its Ms temperature. As illustrated in FIG. 2, following the initial heating of the low alloy steel workpiece to its $A_3$ temperature it is subjected to a predetermined number of cooling and heating cycles around the $A_3$ temperature to refine the grain structure of the austenite. The predetermined temperature changes may be about twenty Celsius degrees (ten degrees above and below the $A_3$ temperature) and the workpiece may be retained for periods of, for example, ten to thirty seconds or more at the selected temperatures. The heating and cooling may, for example, be accomplished by moving the workpiece between different sections of one or more furnaces. It may also be accomplished, for example, by temperature management of an induction heating system. And, as stated above in this specification, the thermal cycling may be ended (and the quench commenced) with the thermally cycled workpiece at a temperature either above or below the $A_3$ temperature. In the process illustrated in FIG. 2, the quench is performed when the workpiece is above its $A_3$ temperature and in the fully austenitized state (as indicated by process point A in FIG. 2.

This quench is indicated at the right side of FIG. 2 (with the workpiece then above the $A_3$ temperature) and in the overall process illustration of FIG. 2. Such thermal cycling prior to the quench below the Ms temperature refines the initial austenite microstructure and renders it more responsive to a quenching and partitioning portion of the heat treatment. Following such cyclical heating and cooling, the austenite phase in the workpiece is distributed as finer grains which encourage the retention of more untransformed austenite upon quenching to martensite. Furthermore the refined martensite/austenite constituent provides shorter diffusion distances for more effective partition of both carbon and substitutional solutes for further stabilization of the austenite upon the final quench. A goal of the processing of this invention is to increase the carbon content of the retained austenite as well as the amount of retained austenite in the workpiece before it is subjected to forming. The greater volume fraction of retained austenite results in improved ductility. Additionally, the refined microstructure established prior to the initial quench is retained throughout processing resulting in greater strength of the steel.

As indicated in FIG. 2, the cyclically heat treated workpiece is now quenched below its Ms temperature to a quench temperature (Q). At quench temperature, Q, the workpiece starts transformation of its refined austenite to martensite. The microstructure consists of retained austenite (as refined by the thermal cycling around $A_3$) with its carbon content, which is generally equal to the original carbon content of the low alloy steel. The microstructure also contains martensite, and the martensite also has carbon associated with it in proportion to the carbon content of the original low alloy steel. After reaching the quench temperature and obtaining a uniform temperature in the workpiece, it may be held at its quench temperature (Q, constant temperature, solid line in FIG. 2) for a brief time as more carbon migrates from the martensite and becomes associated with the retained and modified austenite. The workpiece is then quenched to room temperature and is ready for a stamping or other shaping process. In another embodiment of the process of FIG. 2, the workpiece may be heated to a slightly higher temperature (as dashed line process in FIG. 2, as a higher partitioning temperature, P) to more rapidly increase the austenite carbon content. At this higher carbon partitioning temperature, P, more carbon becomes associated with the retained and modified austenite which beneficially improves the ductility of the workpiece. Again, the workpiece is then quenched to nominally room temperature and is ready for stamping or other shaping process.

The combination of times and temperatures for the thermal cycling about $A_3$ and the processing after quenching below Ms may be worked out by experience and testing to yield a microstructure that provides suitable ductility for an intended forming operation and to yield strength in the deformed article.

The time-temperature process graph of FIG. 3 illustrates a variation on the above-described practice of FIG. 2. As in the process of FIG. 2, the workpiece is heated above its $A_3$ temperature and fully austenitized. The austenitized workpiece is heated above and below its $A_3$ temperature a predetermined number of times as illustrated in FIG. 2. But in this embodiment of the invention, the workpiece is quenched when it has been cooled from its austenitized state (process point A in FIG. 3) in a cooling step to a temperature in its intercritical anneal region, below its $A_3$ temperature but above its $A_1$ temperature (process point IA in FIG. 3). The IA temperature point and holding duration is indicated schematically in FIG. 3 to indicate that the temperature and holding time is predetermined to form a desired small amount of proeutectoid ferrite which imparts much of its carbon content to the austenite. In this embodiment, the workpiece is then quenched to temperature Q, below its Ms temperature, while the workpiece contains some proeutectoid ferrite and carbon-enriched modified retained austenite. Following its quench to Q, the processing of the workpiece may follow either of the practices for further carbon enrichment of the modified austenite as described with respect to FIG. 2.

SUMMARY

The subject thermal cycling around the workpiece $A_3$ temperature provides an improved refined austenite microstructure for better ductility and final strength. The conventional Quench (immediately after austenization of the workpiece) and Partitioning approach seeks to maximize the volume fraction of retained austenite by immediately quenching the austenitized steel to an optimal quench temperature and then further heat treating at a (sometimes elevated) partition temperature. The partitioning step is intended to redistribute carbon and possibly other austenite-stabilizing solutes to the austenite phase to further stabilize it against transformation upon the final quench to room temperature.

As described in detail above, this invention improves the strength and ductility of a Quench and Partition steel by addition of a novel preliminary heat treatment step. Here the steel is first fully austenitized by heating briefly above the $A_3$ temperature characteristic of the particular steel composition. The temperature of the steel is then cycled by cooling slightly below the $A_3$ temperature and then slightly back above the $A_3$ temperature. Thermal cycling above and below the $A_3$ temperature refines the microstructure before retaining austenite by quenching below the martensite start temperature. With each excursion below the $A_3$ temperature, into the two-phase ferrite plus austenite phase region, proeutectiod ferrite is precipitated on the austenite grain boundaries, thus establishing an increase in ferrite/austenite interphase boundary area. With each excursion above the $A_3$ temperature, the steel is re-austenitized by precipitation of austenite on the grain boundaries and interphase boundaries. The nucleation sites are more numerous and thus the austenite grain size is reduced. With each repetition of the thermal cycling around the $A_3$ temperature the microstructure is further refined. As is now apparent, this thermal cycling around the $A_3$ temperature provides advantages.

First, more retained austenite is obtained. As the austenite constituent is reduced in size by thermal cycling it is more stable against transformation to martensite and thus easier to retain upon quenching. Second, greater austenite stability is realized by improved solute partitioning. Since the microstructure is significantly more refined, the diffusion distances are correspondingly reduced to enable more effective partitioning of austenite-stabilizing solutes to the retained austenite prior to final quench. Thus, ductility is improved. And third, increased strength is obtained in the formed product. The strength is influenced by the scale of the matrix microstructure. By first establishing a refinement of the austenite, or austenite plus ferrite, microstructure prior to the initial quench the strength o the steel is increased.

Practices of the invention have been illustrated by some examples and graphs. But the scope of the invention is not intended to be limited by such illustrative examples.

The invention claimed is:

1. A method of heat treating a low alloy carbon steel composition workpiece to improve its ductility for shaping into an article of manufacture and to provide improved strength in the shaped article, the low alloy carbon steel workpiece having a carbon content and, initially, a ferritic microstructure; the method comprising:

heating the steel composition workpiece to a first temperature above its $A_3$ temperature until the microstructure of the steel composition workpiece is transformed into grains of austenite;

cooling the steel composition workpiece to a second temperature below its $A_3$ temperature for a cooling period to commence precipitation of ferrite at the grain boundaries of the grains of austenite, the second temperature and the duration of the cooling period being determined to retain a major portion of the austenite grains in the microstructure;

reheating the steel composition workpiece to a temperature above its $A_3$ temperature for a re-heating period to reform new austenite grains from precipitated ferrite at austenite grain boundaries that were not transformed to ferrite;

repeating the cooling of the steel composition workpiece below its $A_3$ temperature and the reheating above its $A_3$ temperature to obtain a predetermined microstructure of changed and reformed austenite grains; and then, when the steel composition workpiece is at a temperature, either above or below its $A_3$ temperature;

quenching the steel composition workpiece to a quench temperature below its $M_s$ temperature and above its $M_f$ temperature to commence formation of martensite from the changed and reformed austenite, and to obtain a proportion of retained austenite in the microstructure of the workpiece; and, thereafter quenching the steel composition workpiece to an ambient temperature to prepare the steel composition workpiece for a forming operation.

2. A method of heat treating a low alloy carbon steel composition workpiece as recited in claim 1, and, following the step of quenching the steel composition workpiece to a quench temperature below its $M_s$ temperature and above its $M_f$ temperature, further comprising maintaining the steel composition workpiece below its $M_s$ temperature and above its $M_f$ temperature for a time period to increase the proportion of retained austenite before quenching the steel composition to an ambient temperature.

3. A method of heat treating a low alloy carbon steel composition workpiece as recited in claim 1, and, following the step of quenching the steel composition workpiece to a temperature below its Ms temperature and above its Mf temperature, further comprising heating the steel composition workpiece above its quench temperature to increase the proportion of retained austenite before quenching the steel composition to an ambient temperature.

4. A method of heat treating a low alloy carbon steel composition workpiece as recited in claim 1 in which the composition of the low alloy carbon steel composition comprises, by weight, carbon in an amount up to about 0.4%, manganese in an amount up to about 1.5%, optionally silicon in an amount up to about 1%, optionally aluminum in an amount up to about 1%, and iron.

5. A method of heat treating a low alloy carbon steel composition workpiece as recited in claim 1 in which the steps of cooling the steel composition workpiece below its $A_3$ temperature and reheating above its $A_3$ temperature is repeated two or more times in obtaining the predetermined microstructure of changed and reformed austenite grains.

6. A method of heat treating a low alloy carbon steel composition workpiece as recited in claim 1 in which temperatures to which the low alloy carbon steel composition workpiece is respectively heated above and below its $A_3$ temperature are within about ten Celsius degrees of the $A_3$ temperature.

7. A method of heat treating a low alloy carbon steel composition workpiece as recited in claim 1 in which the durations of the respective heating and cooling periods around the $A_3$ temperature are no longer than about thirty seconds.

8. A method of heat treating a low alloy carbon steel composition workpiece as recited in claim 1 in which the heating and cooling of the workpiece above and below the $A_3$ temperature is conducted so that the workpiece, ready for forming at ambient temperature, possesses greater ductility for forming than an identical workpiece that is austenitized, without thermal cycling around its $A_3$ temperature, but otherwise identically processed for forming.

9. A method of heat treating a low alloy carbon steel composition workpiece as recited in claim 1 in which the workpiece is in the form of a sheet, rolled or unrolled.

10. A method of heat treating a low alloy carbon steel composition workpiece as recited in claim 1 in which the workpiece is in the form of a sheet, rolled or unrolled and the sheet material is subjected to a stamping operation at an ambient temperature to form a shaped workpiece having regions of greater strength than the sheet material before stamping.

* * * * *